US006101801A

United States Patent [19]

Boni

[11] Patent Number: 6,101,801

[45] Date of Patent: Aug. 15, 2000

[54] METHOD FOR HANDLING THREADS IN SPIRALLING MACHINES

[75] Inventor: Romano Boni, Gottolengo, Italy

[73] Assignee: Celbo S.N.C. di Boni Romano & C., Italy

[21] Appl. No.: 08/965,370

[22] Filed: Nov. 6, 1997

[30] Foreign Application Priority Data

Dec. 12, 1996 [IT] Italy ..... MI96A2611

[51] Int. Cl.[7] ..... D01H 3/36

[52] U.S. Cl. ..... 57/18; 57/3; 57/10

[58] Field of Search ..... 57/3, 10, 11, 18

*Primary Examiner*—William Stryjewski

*Attorney, Agent, or Firm*—Hedman, Gibson & Costigan, P.C.

[57] ABSTRACT

Threads (15) are handled in spiralling or covering machines with improved efficiency by replacing traditional bobbins (20) with double-coned bobbins (10) which include flanges (22) at both ends and by providing that the outside edges of the flanges do not project beyond the level of the unwinding thread.

2 Claims, 1 Drawing Sheet

METHOD FOR HANDLING THREADS IN SPIRALLING MACHINES

BACKGROUND OF THE INVENTION

1. Field of the Invention

This invention relates to a method for handling threads in spiralling or covering machines, and to a spiralling machine or covering machine using that method.

2. Description of the Related Art

To be able to be used, transported and stored, thread has to be wound on supports, which are of various forms and sizes according to the specification of the machine which is to use it in the next process.

Winding is achieved, using winding machines, by depositing the thread on a rotating cylinder or bobbin, which is in the form either of a simple tube or, preferably, a cylinder provided with flanges at one or both ends to retain the wound thread. Flangeless bobbins are preferably used on machines which unwind the thread without rotating the support on which the thread is wound.

Yarn used for producing certain types of fabric or hosiery of considerable elasticity is produced by covering an elastic thread with a spiral of normally non-elastic thread, which improves its appearance and strength.

This operation is performed by machines known as covering or spiralling machines.

For reasons of clarity and brevity, in the ensuing description only the term "spiralling machine" will be used instead of the two alternative team "spiralling machine" and "covering machine". In these machine a winding of thread in bobbin from is rotated at high speed (up to 25,000 r.p.m. and beyond) on an internally hollow rotary shaft (spindle).

A thread (usually the elastic part of the yarn) runs through the hole in the spindle, travelling longitudinally along the central axis of the bobbin, while the spindle rotates.

At the same time, the thread present on the rotating bobbin unwinds at one end to deposit as a spiral on the central thread. Yarn combinations can be produced from different threads originating from different bobbins, possibly rotating in opposite directions, and wound as a spiral on the central thread.

Currently, for this type of machine cylindrical bobbins are used flanged at one or both ends, with the flange surface perpendicular to bobbin axis or of frusto-conical shape so that the thread section along a plane on which the bobbin axis lies defines a parallelogram.

Although such a winding presents good unwinding speed and good thread retention, it however produces numerous problems both during spiralling and during bobbin preparation.

Firstly, it is totally unsuitable for unwinding the thread with the support at rest.

Moreover, when the thread is unwound from the bobbin for spiralling, it periodically unwinds from turns close to the flange.

As the flange projects outwards from the wound turns, in such cases the force required to unwind the thread is such as to damage and/or break the thread, which is compelled to travel through a large curve before reaching the thread on which it is to be spirally deposited.

This means that the thread slides on the entire remaining part of the winding and on the inner surfaces of the flanges, with the consequent possibility or displacement and overlapping of the turns and relative hold-ups in unwinding in correspondence with the flange situated at the unwinding end, where the thread can remain squashed between the flange and the adjacent turns.

Moreover, when winding the thread onto a flanged bobbin by a winding machine, the operator has to very accurately adjust manually the turn arrangement at the bobbin ends, so as to ensure that no accumulations or shortages are present.

In this respect, a thread arrangement which is not perfectly uniform could prejudice regular thread unwinding during the subsequent spiralling operation.

Finally, even minimum mechanical deformation of a flange (due to possible constructional defects thereof or to impact suffered during use) results in overall unbalance in the rotation of the spindle carrying the bobbin, with consequent reduction in the average life of the mechanical components, such as ball bearings, of the spiralling machine.

An object of the present invention is to indicate a method for handling threads in spiralling machines which obviates the aforesaid drawbacks.

A further object of the present invention is to indicate a method for handling thread in spiralling machines which does not require the use of complicated or particularly costly techniques.

A further object of the present invention is to indicate a method by which the manufacturing and operating costs of spiralling machines can be reduced with respect to the known art.

A further object of the present invention is to provide a spiralling machine which uses the method of the present invention.

BRIEF SUMMARY OF THE INVENTION

These and further objects are attained according to the present invention (i) by a method for handling threads (15) in spiralling or covering machines, in which at least one bobbin (10, 20) is used formed on a cylindrical, conical or double-cone support, on which a first thread (15) is wound by winding machines and from which, for spiralling purposes, said first thread (15) is unwound during the rotation of said bobbin (10) by traction starting from a point positioned on the axis of rotation of said bobbin (10, 20), and deposited on at least one second thread (25) passing through the spindle (30) of said bobbin (10, 20), characterised in that said bobbin (10) is of the conical type, ie is of frusto-conical shape at at least of of its ends (16, 17), such that the geometrical profile of the lateral surface of the bobbin (10) when viewed frontally is trapezoidal, and (ii) by a spiralling machine using at least one bobbin (10, 20), said bobbin (10, 20) being wonded on a cylindrical, conical or double-cone support on which a first thread (15) is wound by winding machines and from which, for spiralling purposes, said first thread (15) is unwound during the rotation of said bobbin (10) by traction starting from a point positioned on the axis of rotation of said bobbin (10, 20), and deposited on at least one second thread (25) passing through the spindle (30) of said bobbin (10, 20), characterized in that said bobbin (10) is of the conical type, ie is of frusto-conical shape at at least one of its ends (16, 17), such that the geometrical profile of the lateral surface of the bobbin (10) when viewed frontally is trapezoidal.

Advantageously the method of the present invention uses conical bobbins in place of traditional flanged bobbins for unwinding the thread, which is then treated to assume the spiral form.

In a preferred embodiment of the present invention double-cone bobbins are used, ie cylindrical bobbins having a frusto-conical profile at both ends.

BRIEF DESCRIPTION OF THE SEVERAL VIEWS OF THE DRAWING

Further objects and advantages of the present invention will be apparent from the ensuing description and from the accompanying drawings, which are provided by way of non-limiting example and on which.

DETAILED DESCRIPTION OF THE INVENTION

Figure 2:
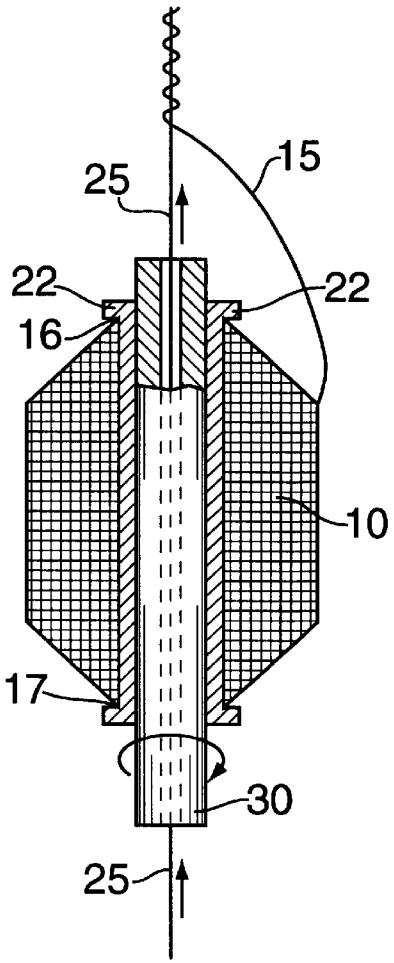
FIG. 2 is a partly sectional view of a preferred embodiment of a bobbin and spindle adapted for use in spiralling machine in accordance with the present invention.

In the said figures, the reference numeral 20 indicates a traditional bobbin provided with flanges 22, while 10 indicates a bobbin which is conical at its upper end 16 and lower end 17. The reference numeral 30 indicate the support spindles for the bobbins 10, 20, and 25 indicates a thread about which the thread 15 is wound in spiral form.

The thread 15 is wound on the bobbin 10, 20 by a winding machine. This operation has to be carried our with particular care in the case of bobbins 20 with flanges 22 so that there are no accumulations or shortages of thread 15 close to the flanged ends, and that the winding is perfectly uniform on the spindle 30. This is made necessary by tie fact that a poorly uniform winding demonstrates poor unwinding characteristics during the subsequent spiralling to which it is subjected.

In this respect, if the thread 15 has not been uniformly wound along the entire spindle 30, it could be squashed below the flanges 22, which project beyond the level of the winding, in correspondence with the regions 27 in which the thread 15 is subjected to an upward traction force and sudden folding towards the outside of the bobbin 20.

In contrast, if conical bobbins 10 are used, the operator does not have to manually check the arrangement of the thread 15 along the entire spindle 30 during winding as the thread 15 does not come into contact with the flanges 22, which can be of reduced dimensions (in this respect see the bobbin 10 of FIG. 2) and provided only to facilitate manipulation of the bobbin 10. During spiralling, the thread can unwind following a trajectory much more linear than in the preceding case.

Figure 1:
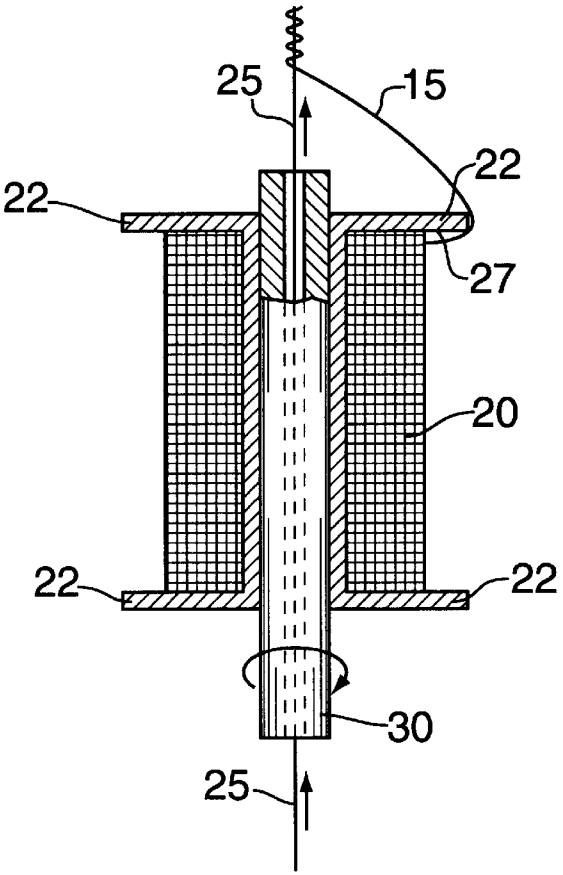
FIG. 1 Prior Art
FIG. 1 is a partly sectional view of a preferred embodiment of a bobbin and spindle used in spiralling machine of the known art.

To have an immediate idea of the difference, compare the unwinding directions of the thread 15 for traditional bobbins 20 (FIG. 1) and for double-cones bobbins 10 (FIG. 2).

To maintain shape during its winding on the spindle 30 without the aid of retaining flanges 22, the thread 15 is wound by winding machines with large turn pitches and high rotational speeds both of the bobbin 10 and of the thread guide.

In this case the growth of the thread 15 is automatically centered, and the bobbins 10 can be freely changed on the winding machines without having to subject them to preliminary manual adjustment to centre the package of thread 15 relative to the flanges 22.

The bobbin 10 prepared in this manner is then ready for mounting on the spiralling machine and be subjected to the desired handling.

Using bobbins 20 with flanges 22 in spiralling machines also presents further problems which are obviated by the use of conical bobbins and preferably of double-cone bobbins.

Firstly, because the bobbins rotate at very high speed (20,000–25,000 r.p.m.) during the unwinding of the thread 15, the presence of flanges 22 having a diameter equal to the maximum dimension of the bobbin 20 results in the movement of large air masses, increasing energy consumption.

In this respect, with bobbins 10, 20 full of thread 15 the energy consumption is virtually the same whether bobbins 20 with flanges 22 or conical bobbins 10 with reduced-size flanges 22 are used, however as the thread 15 gradually unwinds from the bobbin 10, 20 and winds onto the thread support 25 electrical energy consumption decreases if conical or double-cone bobbin 10 are used, where it remain sudstantially unchanged in the case of flanged bobbins 20.

This saving in energy consumption is particularly evident in handling large thread quantities wound on a large number of bobbins.

In this respect, it is not unusual for spiralling operations to involve in one and the same plant up to 100,000 rotating bobbins operating simultaneously.

The use of bobbins 10 without flanges 22 or with flanges having a size less than the maximum diameter of the winding also reduces vibration of the spiralling machine and the total weight of the structure.

In such a case, the actual weight of the flanges 22 can be converted into extra thread 15 (compared with known methods) wound on the conical bobbin 10.

The result is that for equal loads acting on the spiralling machine bearings, if conical bobbins 10 are used the useful product yarn obtained is greater than the product obtained using flanged bobbins.

Furthermore, even minimum mechanical deformation of the flanges 22 (due to possible structural defects, constructional errors or impact during use) would cause unbalance during rotation of the spindle 30 which, because of the high speeds concerned, would result in drastic reduction in the average life of the ball bearings.

Moreover the of conical or double-cone bobbins 10 in spiralling processes enable the spiralling machines to be of more simple construction than the known art, using a minimum quantity of components and hence limiting the manufacturing and operational costs.

In this respect, the construction of a bobbin 10 without flanges 22 or with flanges 22 of reduced dimensions is simpler and less costly than a traditional bobbin 10.

The characteristics of the method for handling threads in spiralling machines and of the spiralling machine of the present invention are apparent from the a foregoing description, as are their advantages.

These specifically regard the following aspects:

- less time lost due to spindle stoppages deriving from faults or malfunction during spiralling, compared with the known art;
- greater yarn productivity compared with the known art;
- possibility of automating the winding system and the subsequent spiralling;
- lesser manufacturing and running costs of the spiralling machine compared with the known art.

It is apparent that modifications can be made to the thread handling method and spiralling machine of the present invention without thereby leaving the novel principles of the inventive idea, it being further apparent that in the practical implementation of the product deriving from the new method the materials, forms and dimensions of the illustrated details can be chosen according to requirements and can be replaced by others technically equivalent.

I claim:

1. In a method for handling threads in a spiralling or covering machine, wherein at least one bobbin is used to supply a first thread for unwinding during the rotation of said bobbin by traction starting from a point positioned on the axis of rotation of said bobbin and thereafter depositing said first thread on at least one second thread passing through and exiting from a spindle around which said bobbin rotates, the improvement which comprises providing and using a bobbin which is of frusto-conical shape at both of its ends, such that the geometrical profile of the lateral surface of the bobbin when viewed frontally is trapezoidal, and providing said bobbin with a plurality of flanges, one at each of its ends, the major dimension of each said flange being less than the maximum diameter attainable by the winding of said first thread on the spindle of said bobbin.

2. In a bobbin adapted for use in spiralling machine wherein at least one bobbin, is used to supply a first thread for unwinding during the rotation of said bobbin by traction starting from a point positioned on the axis of rotation of said bobbin and thereafter depositing said first thread on at least one second thread passing through and exiting from a spindle around which said bobbin rotates, the improvement which comprises said bobbin having a frusto-conical shape at both of its ends, such that the geometrical profile of the lateral surface of the bobbin when viewed frontally is trapezoidal, said bobbin further including a plurality of flanges, one at each end, the major dimension of each said flange being less than the maximum diameter attainable by the winding of said first thread on the spindle of said bobbin.

* * * * *